US005216403A

United States Patent [19]

Bergquist et al.

[11] Patent Number: 5,216,403

[45] Date of Patent: Jun. 1, 1993

[54] RELAY

[75] Inventors: Per-Marcus Bergquist, Lidingö; Henrik E. Troberg, Tumba, both of Sweden

[73] Assignee: Aktiebolaget Electrolux, Stockholm, Sweden

[21] Appl. No.: 955,094

[22] Filed: Oct. 1, 1992

[30] Foreign Application Priority Data

Oct. 14, 1991 [SE] Sweden ..... 9102971

[51] Int. Cl.[5] ..... H01H 61/02; H01H 71/18

[52] U.S. Cl. ..... 337/123; 337/141

[58] Field of Search ..... 337/141, 140, 139, 123, 337/124, 125, 126, 127, 101, 102, 78, 36, 37, 38, 39, 40

[56] References Cited

U.S. PATENT DOCUMENTS 3,239,632 3/1966 McMullen ..... 337/141
5,023,587 6/1991 BHerquist et al. ..... 337/123

FOREIGN PATENT DOCUMENTS 1639272 2/1971 Fed. Rep. of Germany .
2360167 6/1975 Fed. Rep. of Germany .
782446 6/1935 France .
968492 11/1950 France .
7015390 1/1972 France .
128188 5/1950 Sweden .

*Primary Examiner*—Harold Broome
*Attorney, Agent, or Firm*—Pearne, Gordon, McCoy & Granger

[57] ABSTRACT

A relay including a control circuit which via a movement creating or actuating arm and a transmission mechanism activates a contact means in order to switch on or switch off a main circuit. The actuating arm includes two elongated parallel parts which are separated by a thermally and electrically insulated layer. The two parallel parts each have a first end fastened to a housing or holder. The two parallel parts each have a second end fixed to each other, forming a movable end of the arm. One or both parallel parts of the arm are provided with a heat creating or producing element. The actuating arm, attached at one end and movable at the other end, together with the heat producing element, constitutes the first part of the control circuit or relay. When a control current flows through the heat producing element, one of the two parallel parts of the arm is heated thereby causing a movement of the movable end of the arm to thereby activate the control means through the transmission mechanism. The transmission mechanism includes a finger extending mainly perpendicular to the length direction of the movable arm, with the finger acting on a leaf spring. The leaf spring is generally parallel to the arm, the spring supports said contact means which switch on or off the main circuit.

10 Claims, 1 Drawing Sheet

RELAY

BACKGROUND OF THE INVENTION

This invention relates to a relay including a control circuit which via a movement creating or actuating arm and a transmission mechanism, activates a contact means in order to switch on or switch off a main circuit. The actuating arm comprises two elongated parallel parts which are separated by a thermally insulated layer. The two parallel parts each have a first end fastened to a holder or base support. The two parallel parts each have a second end fixed to each other, forming a movable end of the arm. One or both parallel parts of the arm are provided with a heat creating or producing element. The actuating arm, attached at one end and movable at the other end, together with the heat producing element, constitutes the first part of the control circuit or relay. When a control current flows through the heat producing element, one of the two parallel parts of the arm is heated thereby causing a movement of the movable end of the arm to thereby activate the control means.

A device of the abovementioned type is previously known, see EP 403453. The device shown in this publication has however certain shortcomings since the transmission mechanism requires relatively large movements of the arm in order to work properly which means that the device achieves a rather large height. At the same time the transmission mechanism and the position of the contact means combine so that the complete arrangement further results in a rather large extension in the length direction of the arm.

The purpose of this invention is to achieve a relay device of the type described above but with a more compact layout than previously known. The device is also suitable for mass production.

BRIEF DESCRIPTION OF THE DRAWINGS

An embodiment of the invention will now be described with reference to the attached drawing on which FIG. 1 shows a vertical section through the device according to the invention whereas

DETAILED DESCRIPTION OF THE PREFERRED EMBODIMENT

Figure 1:
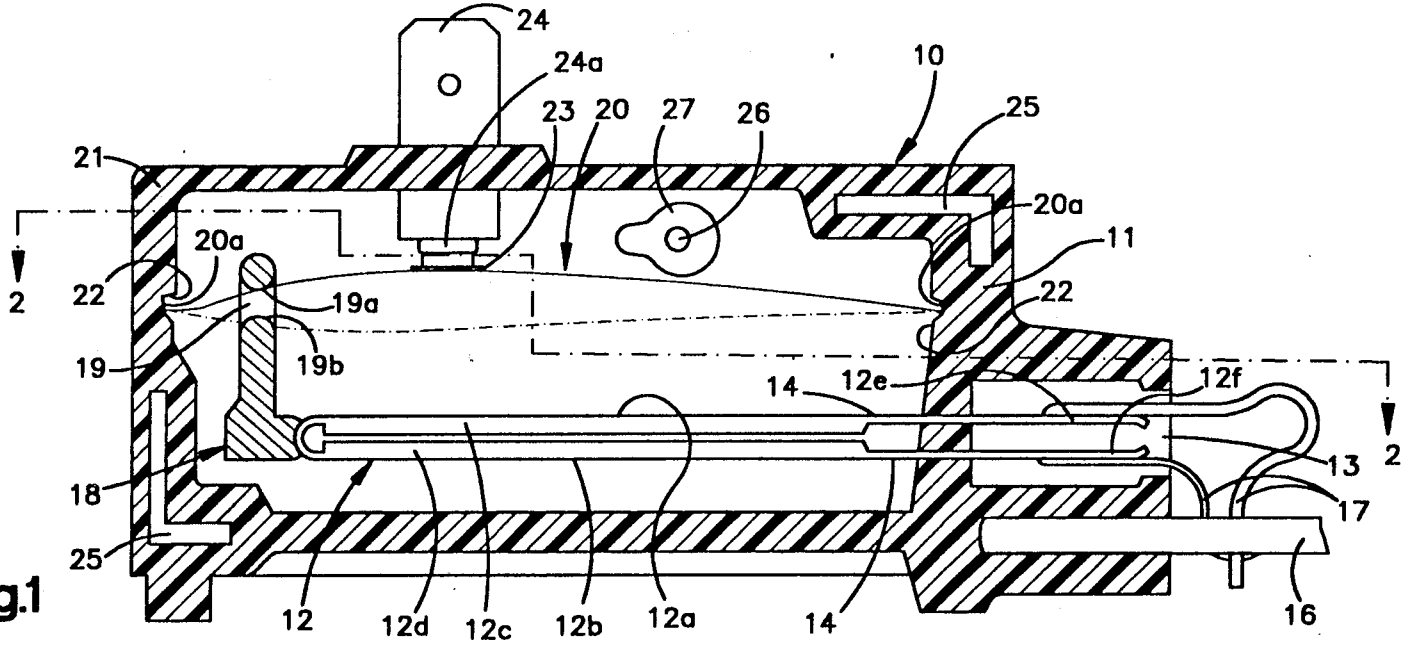
Figure 2:
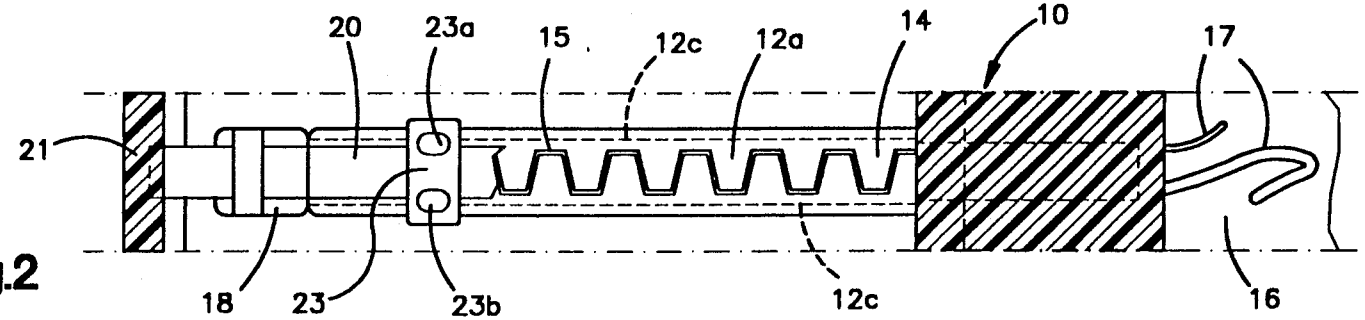
FIG. 2 is a section on the line II—II in FIG. 1.

As appears from the figures, the relay comprises a housing or holder 10 preferably consisting of an electrically insulating plastic material and which serves as a protecting shell for the electro-mechanical arrangement within. The holder has a side wall or base support 11 in which an elongated arm 12 is fixed. The elongated arm comprises two parallel parts 12*a* 12*b*, one disposed generally adjacent and parallel to the other and separated by a thermally insulating layer, i.e., an air gap. Each arm has one end extending through the side wall or base support 11 into a recess 13 outside of the holder 10. The other or second ends of the parts 12*a*, 12*b* are fixed to each other to form a vertically movable free end of the arm 12. Preferably the parts 12*a*, 12*b* are made of sheet metal and, along the major part of the free length of the arm, are provided with side flanges 12*c*, 12*d*. The side flanges serve as reinforcing means for the arm and prevent bending of the arm at other places than at the part 14 adjacent the side wall 11 where it is weakened with respect to bending influences.

One or both parts 12*a*, 12*b* of the arm 12 are equipped with a heat creating or producing element 15 which is activated by and is operative in response to current flowing from a circuit card or board 16, via outer parts 12*e*, 12*f* of the arm which are placed in the recesses 13 and via electric conductors 17 between parts 12*e*, 12*f* and the circuit card 16.

Preferably the arm 12 consists of an oxidized aluminum plate which is folded at the free end of the arm and on which the heat creating element is fastened as a thin layer by means of a known printing method.

The free end of the arm 12 has a finger 18 arranged mainly vertically perpendicular to the length direction of the arm and the finger has an opening 19 with an upper surface 19*a* and a lower surface 19*b* for abutting a leaf spring 20. The finger 18 has such a length that sufficient distance between the control circuit and main circuit is maintained to provide adequate electrical isolation or insulation therebetween.

The spring 20 is clamped between the side wall 11 and an opposite side wall 21 and has bent end parts 20*a* resting in recesses 22 in the walls 11 and 21 respectively. The spring 20 thus being clamped mainly moment free in the walls. The spring preferably consists of sheet metal and has a length which is somewhat greater than the free length of the arm and also greater than the distance between the two recesses 22 which means that the spring achieves a bent shape according to FIG. 1. At the center of the spring 20 there is a contact means 23 having two contact surfaces 23*a*, 23*b* which are electrically connected to each other and which each cooperate with a contact surface 24*a* of two pins 24 which are fastened to the holder 10 and via conduits (not shown) are connected to a main circuit. Since the contact means have a more central position with respect to the finger 18 a positive transmission ratio is created when the arm moves.

The holder 10 also has angular openings 25 through which a profile or support member (not shown) can be inserted. This arrangement allows several holders to be positioned beside each other in order to form complete or multiple- relay packages.

Above the spring 20 there is a shaft 26 extending through the multiple relay package, and which is provided with one or several cams 27 so that when the shaft is turned the cams act on the spring 20.

The device operates in the following manner. At the position shown in FIG. 1 the main circuit, connected to the pins 24, is closed, since the contact surfaces 23*a*, 23*b* are urged towards and held in contact with the contact surface 24*a* of the pins 24 by the spring 20. In order to switch off the main current a control current is guided from the circuit card 16 via the conduit 17 to the heat creating element 15 at the part 12*a* of the arm 12. This means that the part 12*a* is heated and elongated whereas the part 12*b* mainly keeps its length. The outer part of the arm with the finger 18 will now move downwards, so that the abutting surface 19*a* urges the leaf spring 20 downwards. At a certain spring deflection the bistable spring snaps over to the position shown by the phantom dash-dotted lines in FIG. 1. Thus the contact surfaces 23*a*, 23*b* of the contact means 23 are disengaged from the contact surfaces of the pins 24*a*, and the main current thus being switched off. At the same time the circuit card switches off the current to the heating element 15 whereby the arm returns to its original position in which the surface 19*b* now abuts the spring 20.

In order to close the main circuit, a current is in a corresponding way guided to the heat creating element at the lower part 12*b* of the arm 12 which produces an upwardly directed movement of the finger 18, whereby the spring 20 by the abutting surface 19*b* is returned to its original position, as shown in FIG. 1.

If the main current should need to be switched off without being controlled by the circuit card, it is possible to turn the shaft 26 by means of a handle, not shown. Thus the cam 27 presses the spring downwards in FIG. 1 so that the contact means disengages the contact surfaces of the pins 24. Thereby a manual main switch off function is achieved which is a demand in many applications.

The arrangement described above is a bistable arrangement but it is of course possible also to design the relay as a monostable arrangement, i.e., by putting a heat creating element solely on one of the parts of the arm, i.e., the upper in FIG. 1 and by means of some kind of abutting surface below the spring 20 prevent it from snapping over to its lower stable position. Such an arrangement would mean that the main switch is open solely during the time when a current flows through the heat creating element.

What is claimed is:

1. A relay comprising a first part of a control circuit which via a movement creating arm and a transmission mechanism influences a contact means in order to switch on or switch off a main circuit, the arm comprising two elongated parallel parts which are separated by a thermally insulated layer and which at one of their ends are fastened to a holder, the other ends being fixed to each other to form a movable end of the arm and that one or both parts of the arm are provided with a heat creating element, which constitutes the first part of the control circuit and which when a control current flows through the element heats one of the two parts of the arm thereby causing a movement of the movable end of the arm, wherein the transmission mechanism comprises a finger extending mainly perpendicular to the length direction of the arm and acting on a blade shaped spring which is generally parallel to the arm, and the spring includes said contact means.

2. A relay according to claim 1, wherein the ends of the spring are mainly moment free clamped between two fastening points and the free length of the spring being greater than the distance between the fastening points.

3. A relay according to claim 1, wherein the length of the spring is greater than the free length of the arm.

4. A relay according to claim 1, wherein the contact means is positioned more centrally on the spring than is the abutting point of the finger.

5. A relay according to claim 1, wherein the finger has an opening through which the spring extends.

6. A relay according to claim 5, wherein the spring is fastened free of moment in the opening.

7. A relay according to claim 6, wherein the opening has a first and a second abutting surface for the spring the two abutting surfaces being positioned at each side of the spring and at a distance from each other which is larger than the thickness of the spring.

8. A relay according to claim 1, wherein the holder is shaped as an electrically insulated shell surrounding the arm and the transmission mechanism.

9. A relay according to claim 1, wherein the arm is a bent aluminum plate with an oxidized surface on which the heat creating element is printed.

10. A relay according to claim 1, further comprising a cam mechanism which is placed adjacent the spring and when being turned acts on the spring to switch off or switch on the main circuit.

* * * * *